United States Patent [19]

Nail

[11] Patent Number: 4,858,386

[45] Date of Patent: Aug. 22, 1989

[54] ACCURATELY AND EASILY ADJUSTABLE MULLION

[75] Inventor: Billie G. Nail, Glendale, Calif.

[73] Assignee: Adams Rite Manufacturing Company, City of Industry, Calif.

[21] Appl. No.: 290,525

[22] Filed: Dec. 27, 1988

Related U.S. Application Data

[63] Continuation-in-part of Ser. No. 161,960, Feb. 29, 1988.

[51] Int. Cl.[4] ..... E06B 1/04

[52] U.S. Cl. ..... 49/505; 52/126.3; 52/217; 52/243.1

[58] Field of Search ..... 49/505, 366; 52/217, 52/243, 243.1, 126.3

[56] References Cited

U.S. PATENT DOCUMENTS 2,669,862 2/1954 Miller ..... 52/243 X 3,256,659 6/1966 Dudoff ..... 52/243 X 3,274,741 9/1966 Neagle ..... 52/243 X

*Primary Examiner*—Philip C. Kannan

*Attorney, Agent, or Firm*—William W. Haefliger

[57] ABSTRACT

A mullion assembly for a door unit is adjustably attachable to support structure via a connector part. The assembly includes:

(a) an elongated upright million member having T-shape in horizontal cross section, and (b) a foot bracket at an end of the mullion member and being adjustable for connecting the bracket to support structure so that the bracket can be shifted horizontally relative to the connector part fixed to the support structure, and then attached to that part, (c) the foot bracket having T-shape in horizontal cross section to interfit the T-shape of the mullion for blocking sideward motion of the mullion relative to the bracket.

13 Claims, 7 Drawing Sheets

ACCURATELY AND EASILY ADJUSTABLE MULLION

This application is a continuation-in-part of Ser. No. 161,960 filed Feb. 29, 1988.

BACKGROUND OF THE INVENTION

This invention relates generally to mullions used to support strikes for bolts carried by doors; more particularly, it concerns adjustability of such mullions during their installation to facilitate their precision location relative to door edges carrying the strike engaging bolts.

There is need for simple, reliable, easily adjustable means facilitating mullion adjustability during installation. In the past, when the upper and lower ends of mullions were attached to supports or frames, they could not then be accurately adjusted sidewardly without considerable difficulty. This problem is exacerbated when the mullion is to be covered or enclosed by a decorative cover assembly, since it is then the cover assembly that fits to the door edges, and it as well as the mullion must then be adjusted to achieve precision interfit to the door and precision interfit to rotary or other type bolts to strikes carried by the mullion, or cover assembly.

SUMMARY OF THE INVENTION

It is a major object of the invention to provide an easily adjustable assembly meeting the above need and overcoming the described difficulties. Basically, the mullion assembly of the invention is attachable to support structure as by a connector part, and includes:

(a) an elongated upright mullion member having T-shape in horizontal cross section, (b) a foot bracket at an end of the mullion member and having associated adjustable means for connecting the bracket to support structure s that the bracket can be shifted horizontally relative to said connector part fixed to the support structure, and then attached to that part, (c) the foot bracket having T-shape in horizontal cross section to interfit the T-shape of the mullion for blocking sideward motion of the mullion relative to the bracket.

As will appear, the connector part typically comprises a vertical fastener such as a bolt having threaded connection to the horizontal support or frame; and the adjustable means on the foot bracket comprises a through slot receiving the fastener, the slot being elongated in the lateral direction of elongation of the cross piece defined by the T-shape of the bracket.

It is a further object of the invention to provide the T-shape of the mullion with an upright stem which is hollow, with the stem of the T-shape of the bracket aligning with that hollow to block lateral displacement of the mullion relative to the bracket.

A yet further object is to provide a decorative cover assembly having thin walls closely and protectively fitting about the mullion and quickly connected to same as during assembly. In this regard the hollow cover assembly also has T-shape, each of the T-shapes of the cover assembly and mullion having a stem, and there being flange means on and projecting parallel to the mullion T-shape stem; the cover assembly includes wall portions defining a space closely receiving said flange means, and door strike means on said wall portions, the said wall portions connected to said flange means. Also, two strikes are respectively located at opposite sides of the wall portions, the strikes attached to the wall portions and to the mullion flange means projecting therebetween, providing further attachment of the cover assembly to the mullion.

An additional object is to provide a second foot bracket at and connected to the upper end of the mullion, the second foot bracket having the same construction a the first mentioned foot bracket and adjustably connected to second support structure above the upper end of the mullion.

These and other objects and advantages of the invention, as well as the details of an illustrative embodiment, will be more fully understood from the following specification and drawings, in which:

DRAWING DESCRIPTION

Figure 16:
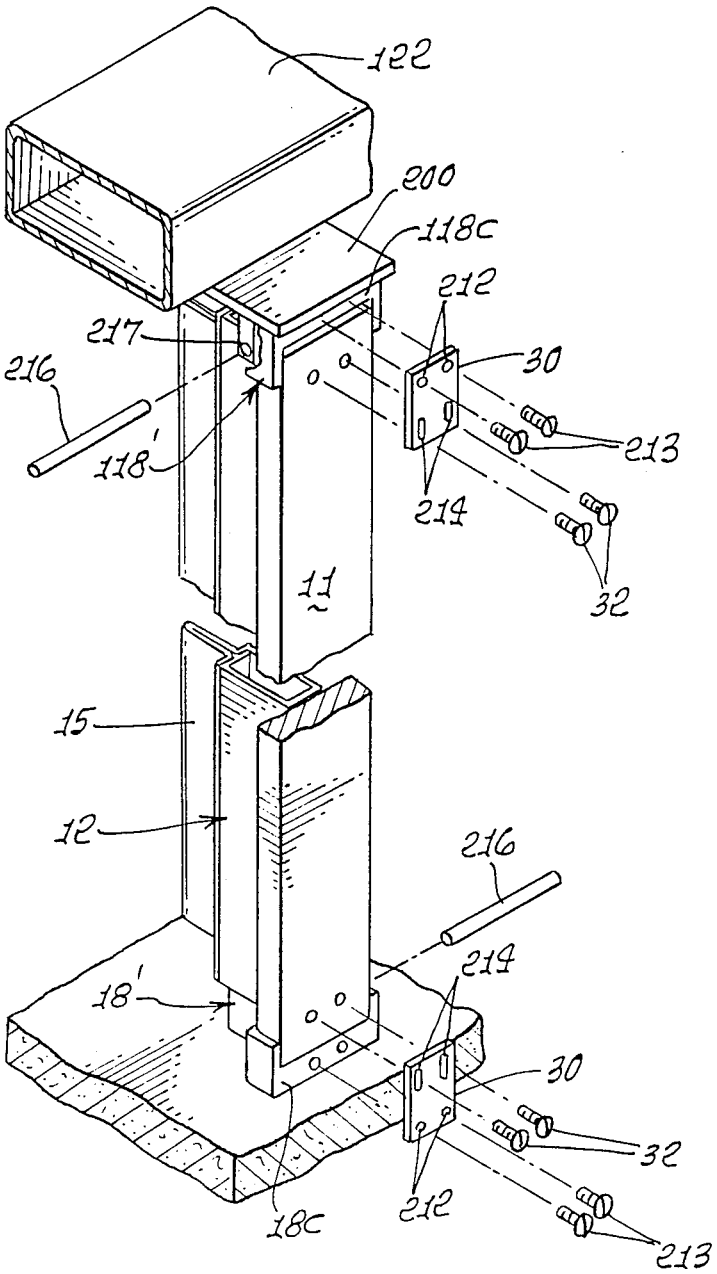
Figure 17:
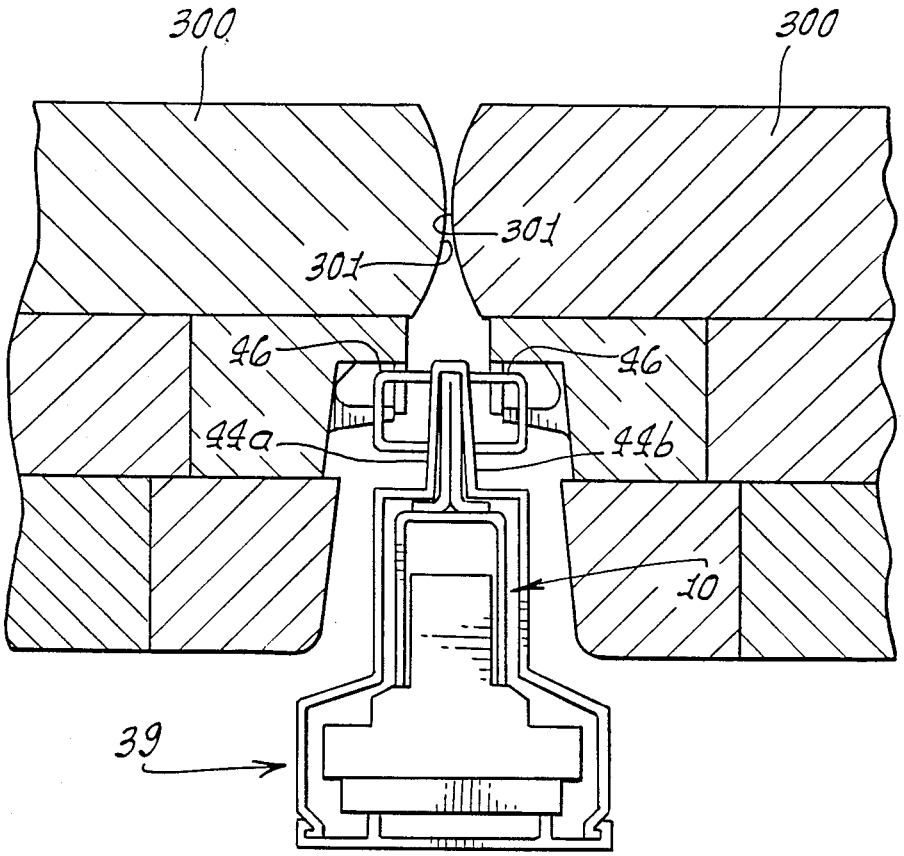

FIG. 16 a perspective view showing final assembly of components less decorative cover; and FIG. 17 is a schematic view.

DETAILED DESCRIPTION

In the drawings, a vertically elongated mullion 10 has an upper end 10*a*, and a lower end 10*b*. It has the same construction throughout its length, and includes upright base plate 11, and a hollow box-like member 12 having vertical end walls 12*a* and 12*b*, and vertical side walls 13*a* and 13*b*. The base plate 11 is rigidly attached to end wall 12*a*, and in horizontal cross section the mullion has T-shape, with a stem formed by 12, and a cross piece formed by 11. See FIG. 4. Also, a flange means 15 is attached to end wall 12*b*to project in direction 45, normal to the plane of the base plate, and throughout the length of the mullion. The flange means has sub-flange 15*a* attached to end wall 12*b*, so that flange means 15 is in a plane bisecting the end wall 12*b*. The structure of the mullion is typically metallic.

Figure 1:
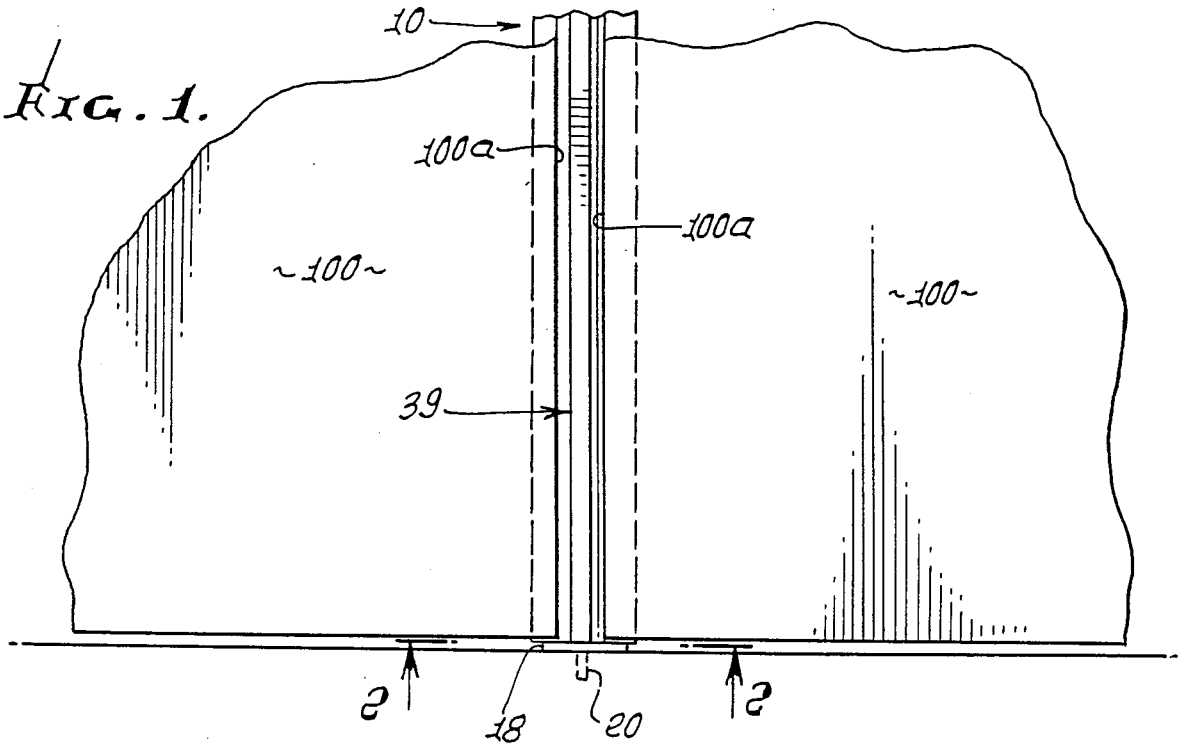
FIG. 1 is a fragmentary elevation showing two doors closed toward and against a mullion, in accordance with the invention.

A foot or mounting bracket 18 is provided at an end of the mullion, and typically at each (upper and lower)

end 10*a* and 10*b* thereof. That bracket has associated adjustable means for connecting the bracket to support structure so that the bracket can be shifted horizontally relative to a connected part fixed to the support structure, and then attached to that part. For example, the connector part typically comprises a vertical fastener such as bolt 20 shown having threaded connection at 21 to the threshold plate 22, or other such support structure, the head 20*a* of the bolt tightened down on the upper surface 23 of the bracket 18. Upon loosening of the bolt, the bracket may be shifted in lateral direction 24 or in lateral direction 25, and to limited extent, as accommodated by a laterally elongated through slot 26 extending vertically in the bracket, the bolt stem passing through that slot. The bracket is typically pivotally connected to the support 22, as by a vertical pin at 27, so that it is shiftable in direction 24 or 25 by pivoting about pin 27. Flat bottom 18*a* of the bracket slidably engages the upper surface of the support upon re-tightening of the bolt, the bracket is firmly assembled to the support, in adjusted position such that the mullion is precisely positioned in relation to doors 100 seen in FIG. 1.

Figure 3:
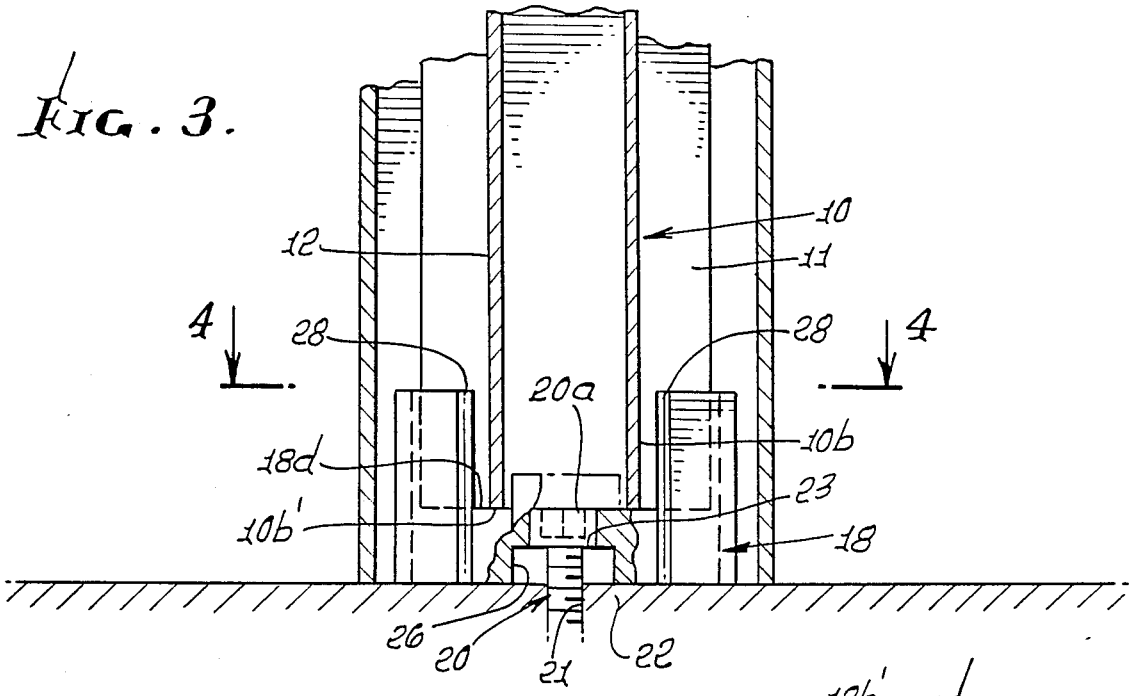
FIG. 3 is an elevation taken in section on lines 3—3 of FIG 2.
Figure 6:
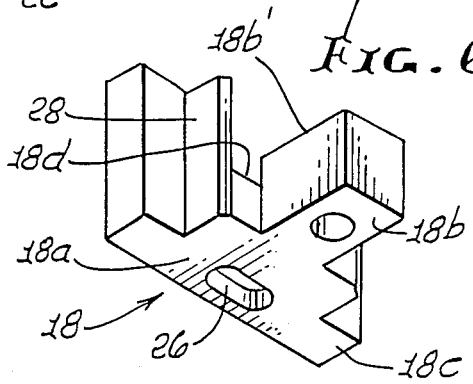
FIG. 6 is a perspective view of a header foot used in the mullion.
Figure 4:
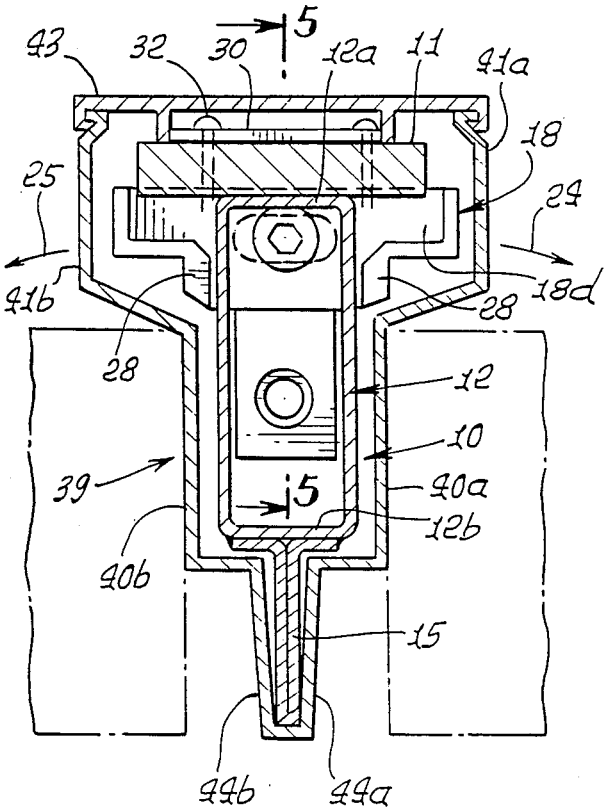
FIG. 4 is a section on lines 4—4 of FIG. 3.

The on piece bracket also typically has T-shape, with a stem 18*b*, and a lateral cross piece 18*c*. It forms vertical integral lugs 28 which are laterally spaced apart to closely confine mullion walls 13*a* and 13*b* therebetween, as seen in FIG. 4. The lowermost end 10*b*′ of the mullion seats on the bracket upper surface 18*d*, as seen in FIG. 3. Also, the bracket stem 18*b* projects at 18*b*′ above the level of upper surface 18*d*, and is closely confined between mullion side walls 13*a* and 13*b*. See FIG. 3. Thus, positive lateral confinement of the mullion by the anchored bracket is assured.

The mullion and connector plate are typically connected by an upright connector plate 30, vertically and sidewardly overlapping the mullion base plate 11 and the cross piece 18*c* of the bracket. Fasteners 32 may provide such attachment. See FIGS. 2 and 4.

Figure 7:
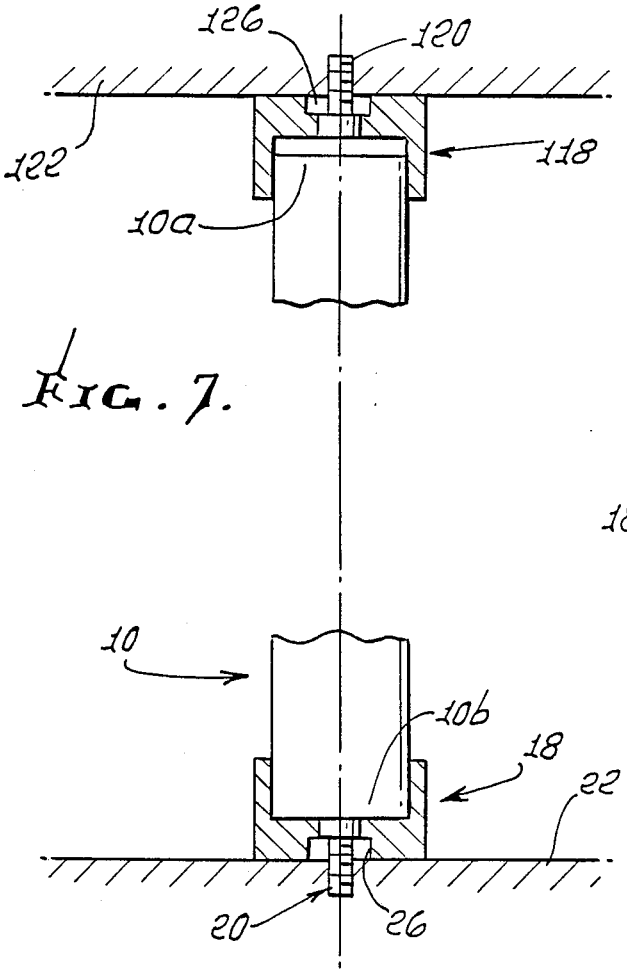
FIG. 7 is a fragmentary elevation showing mullion foot connections at top and bottom of the mullion.
Figure 12:
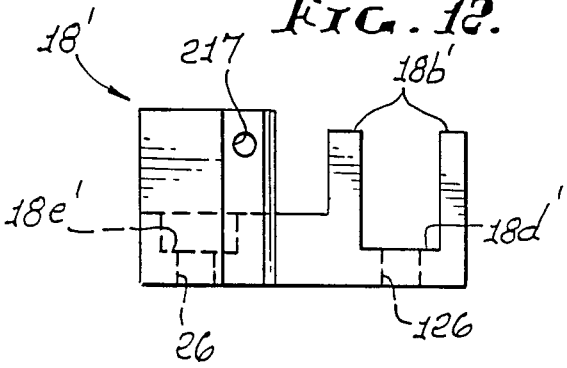
FIG. 12 is a side elevational view of the FIG. 11 bracket.

As shown in FIG. 7, a second bracket 118 is shown at the upper end 10*a*of the mullion 10, and has the same construction as bracket 18. Bracket 118 is also adjustably attached to header plate 122, as by a fastener bolt 120 extending through laterally elongated slot 126, corresponding to slot 26. Accordingly, the mullion may be shifted laterally, toward or away from the edge 100*a* of either door 100.

Figure 2:
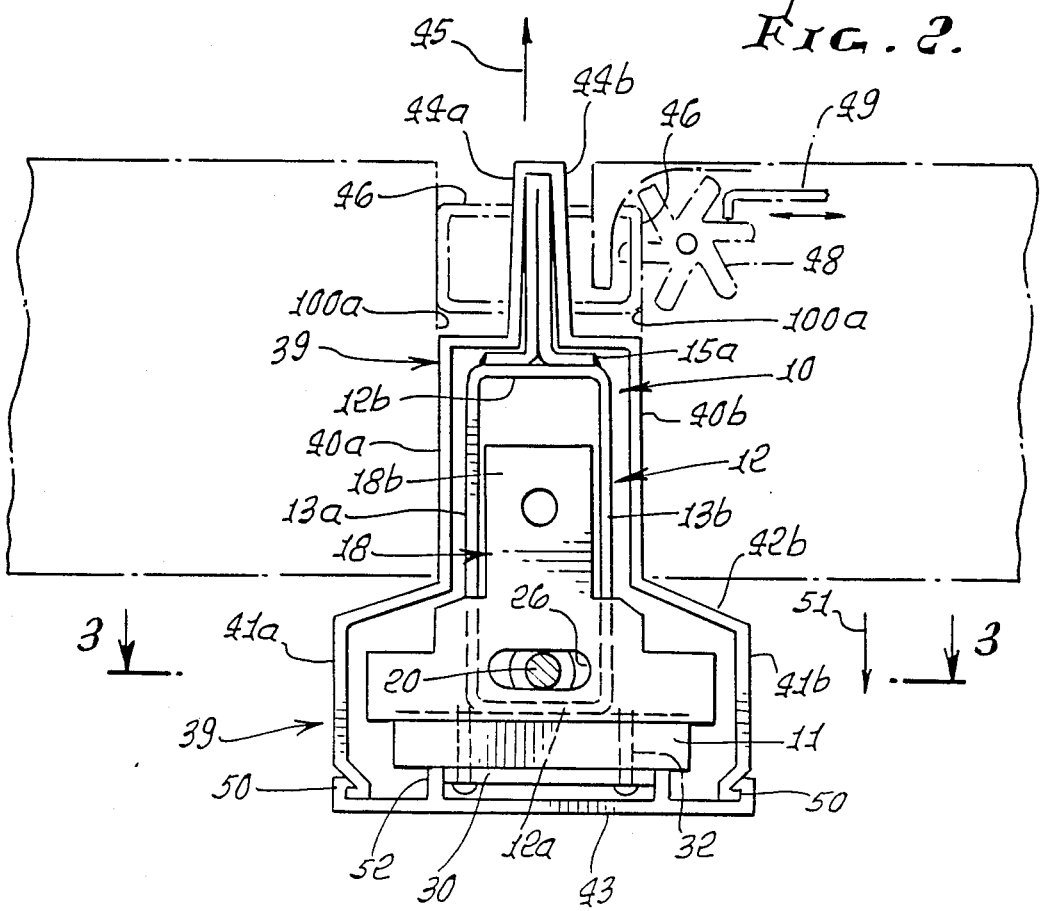
FIG. 2 is an enlarged bottom plan view on lines 2—2 of FIG. 1.

Also provided is a cover assembly 39 having upright walls 40*a* and 40*b*, 41*a* and 41*b*, 42*a* and 42*b*, and a base wall 43, such walls defining a T-shape in horizontal cross section, as seen in FIG. 2. The walls of the assembly 39 fit about the mullion, and are connected to it, as will appear, whereby the cover assembly closely fits the door edge 100*a*, and provides a protected and decorative unit. It may consist of brushed or anodized aluminum, or other metal.

Figure 9:
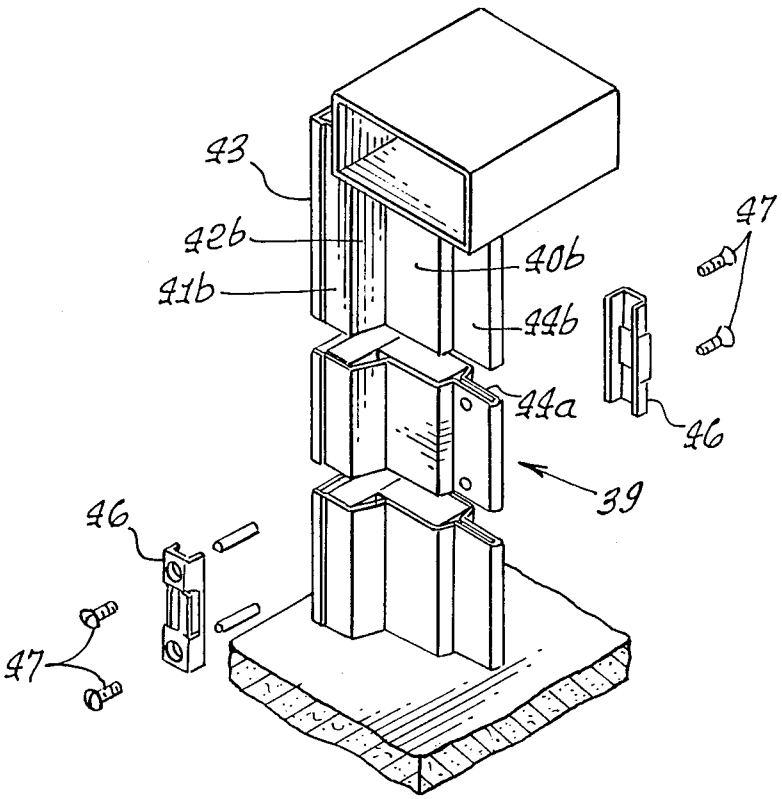
FIG. 9 is an exploded view showing mullion and cover elements partially assembled.
Figure 8:
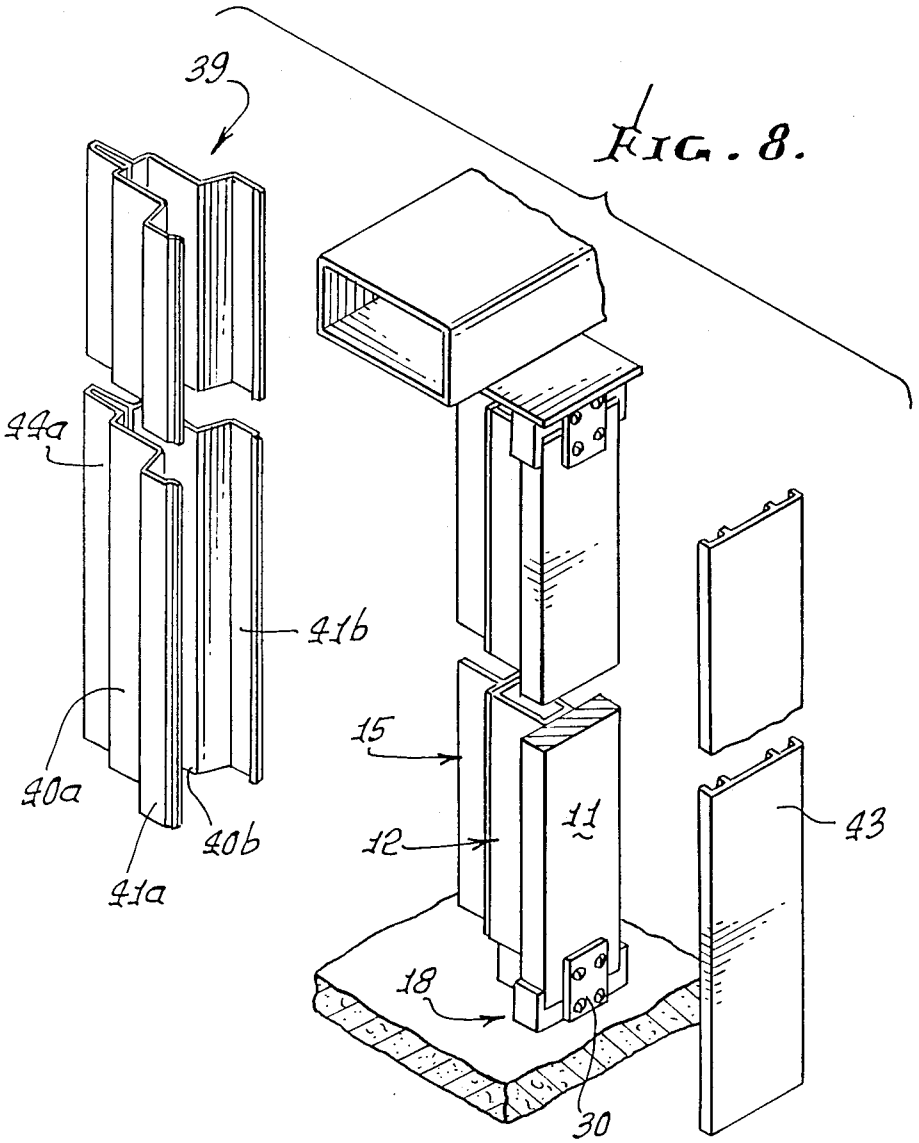
FIG. 8 is a perspective exploded view showing mullion and cover elements in exploded condition.

The "stem" of the mullion cross section, i.e., formed by hollow box-like member 12, fits within the "stem" of the cover assembly 39. The cover assembly 39 has additional walls 44*a* and 44*b* closely spaced apart to fittingly receive the flange means 15 therebetween. Extending the description to FIGS. 9 and 10, door strikes 46 are fastened to the walls 44*a* and 44*b*, as by fasteners 47 connecting the strikes to the flange means 15. The strikes are adapted to receive rotary bolts 48 carried by the doors, as indicated in FIG. 2, in a known manner. The bolts may comprise star wheels, and latching push bars 49 are movable into and out of engagement with the star wheels to block and unblock their rotation relative to the strikes. Suitable panic bar mechanism activates the push bars 49, laterally.

The cover assembly T-shape "base", or end wall 43, has snap-on connection at 50 to the edges of base walls 41*a* and 41*b*, whereby the cover assembly (without wall 43 attached) can be assembled onto the installed mullion in direction 51, after which the base wall 43 is snapped into place. Note flanges 52 on the wall 43, engageable with base plate 11 to position the cover assembly. The spaced flanges 52 engaging the mullion, and the fasteners 47 engaging the mullion, provide three-point centering support for the cove assembly relative to the mullion.

Figure 5:
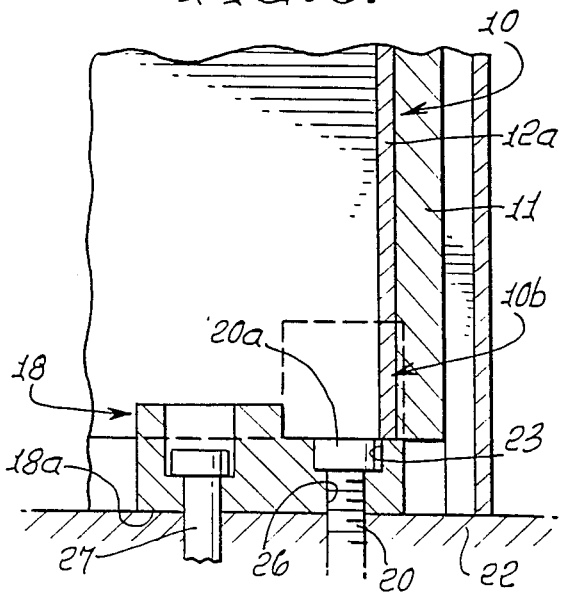
FIG. 5 is a fragmentary elevation taken on lines 5—5 of FIG. 4.

As shown in FIG. 3 and 5, since the bottom and lower end 10*b* of the mullion (which has walls 12*a*, 12*b*, 13*a*, and 13*b*) fits against the top surface 18*d* of the bracket 18 (as referred to above); and since the top of the mullion extends below the surface of the bracket 118, the mullion may be shifted laterally, as referred to above. Therefore, the mullion 10 may be initially shifted laterally between lugs 28 of each bracket 18 and 118 into the position seen in FIG. 4. Suitable vertical clearance, as for example as seen between the top of the mullion and the bracket 118 in FIG. 7, allows relative vertical adjustment of the mullion so as to assume FIG. 4 position. Other such clearance or cutaway of the mullion side of sides may be employed for this purpose.

The mounting brackets 18′ and 118′ seen in FIGS. 11, 12, 13, 14, and 15 are the same as brackets 18 and 118, except that through slot 126 that receives bolt or pin 27 is elongated in a lateral direction, i.e., parallel to through slot 26. Otherwise, the elements of the bracket 18′ and bracket 118′ are the same as those of bracket 18 (and 118), and are correspondingly numbered. Note that the upper surfaces 18*d*′ and 18*e*′ that seat the head 127 of bolt or pin 27, and the head 20*a* of bolt 20 are at a lower level than bracket surface 18*d*, as is clear from FIGS. 5, 11 and 12. Elongation of slot 126 allows lateral bodily adjustment shifting of each installed bracket 18′ prior to tightening of the laterally immovable bolts 20 and 27, and precisely relatively locating the two brackets vertically and laterally to correspondingly precisely locate the opposite ends of the mullion which is to be installed on the two brackets. Bracket 118′ has the same construction as bracket 18′.

Figure 14:
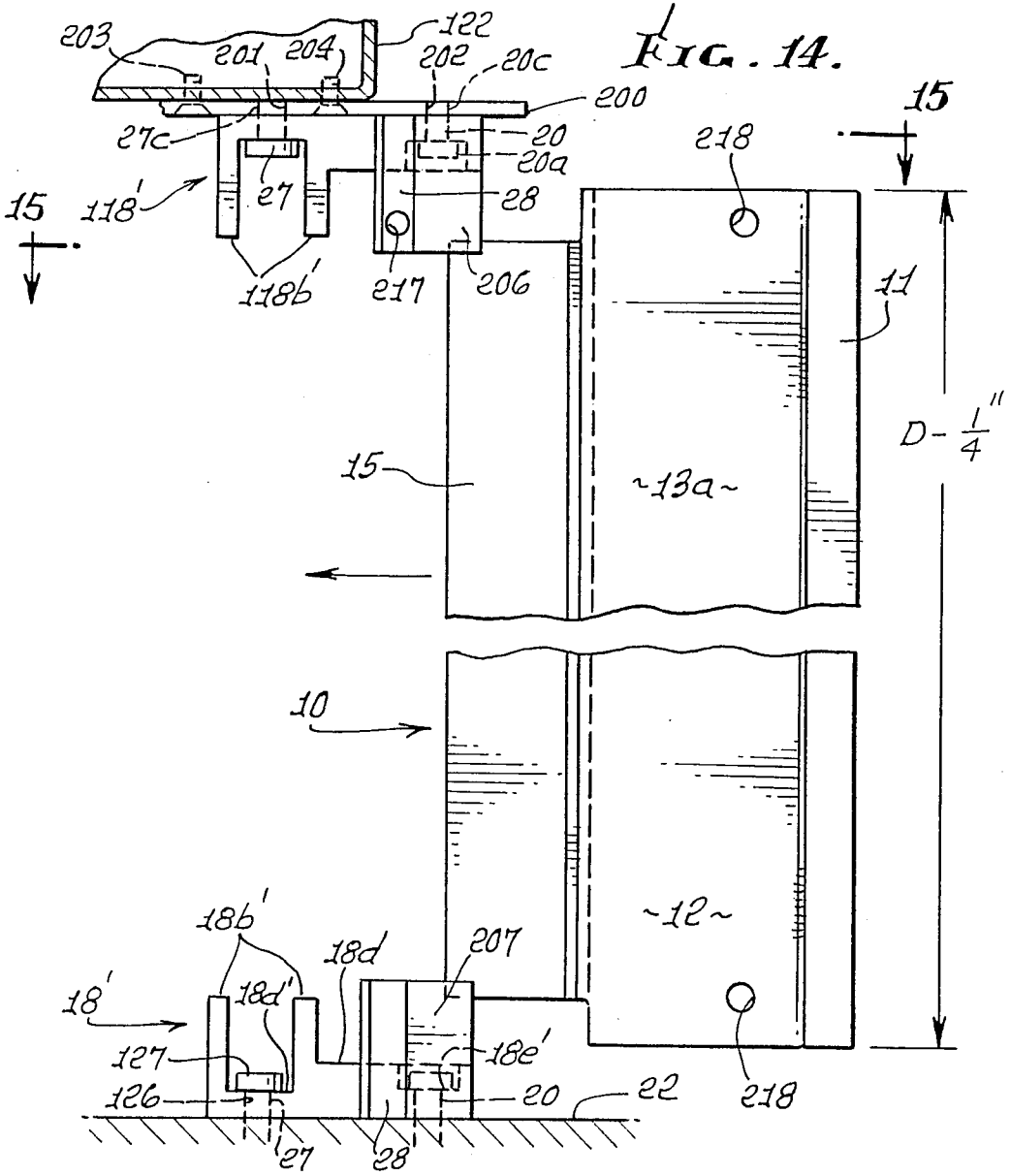
FIG. 14 is a side elevation showing assembly of a mullion to the 13 mounting brackets.
Figure 13:
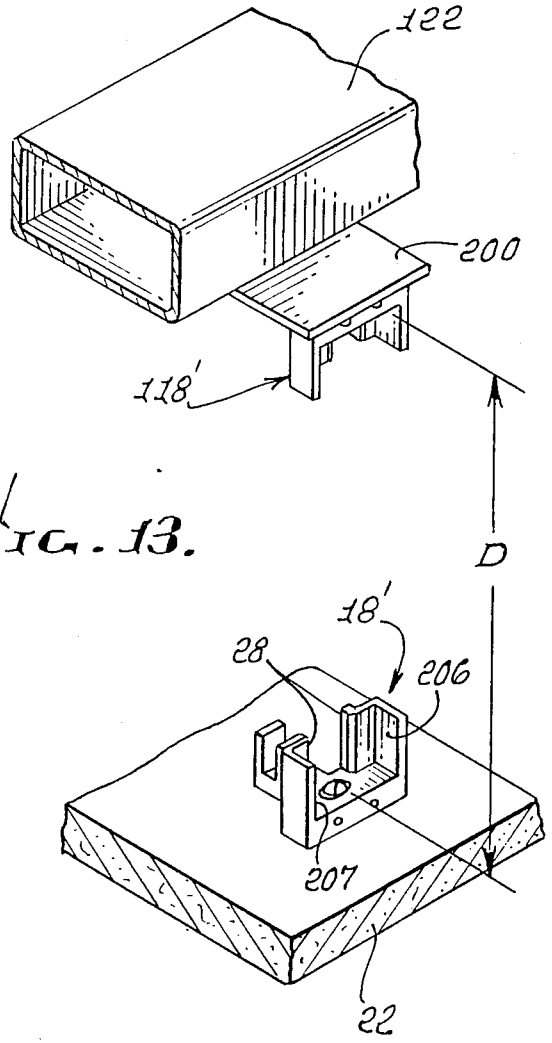
FIG. 13 is a perspective showing installation of upper and lower mounting brackets.
Figure 15:
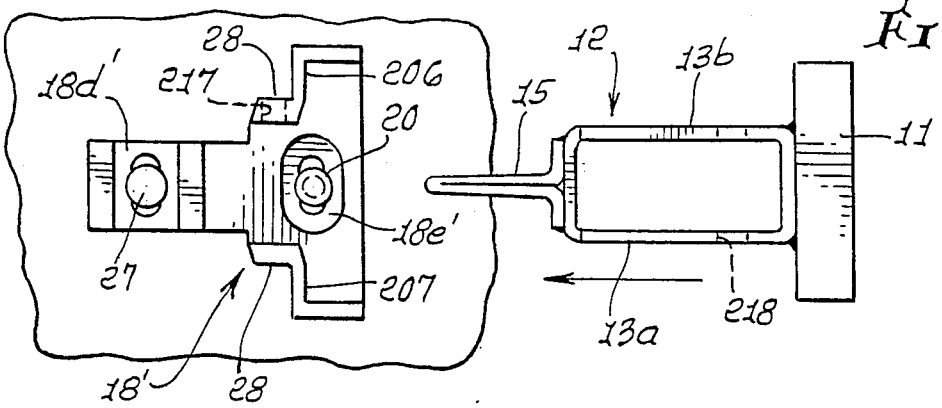
FIG. 15 is a plan view on lines 15—15 of FIG. 4.

In FIGS. 13 and 14, the upper and lower brackets 18′ and 118′ are shown installed in adjusted position, the bolts 20 and 27 being tightened to fit the brackets in position relative to header plate 122 and base plate 22. Note that the upper bracket 118′ is attached via bolts 20 and 27 to a horizontal mounting plate 200, which is in turn attached to the header plate 122. See the threaded ends 20*c* and 27*c* of the bolts attached to threaded openings 201 and 202 in plate 200. Fasteners 203 and 204 in turn attach plate 200 to header 122.

FIG. 14 shows the upright mullion 10 being installed, i.e. advanced leftwardly into assembled relation to the brackets 18′ and 118′, the completed assembly appearing, as in FIG. 2. Vertical flange means 15 then fits between the downward projections 118*b*′ on bracket 118′, and upward projections 18*b*′ on bracket 18′, as the mullion is leftwardly assembled between the brackets. Plate 11 is adapted to engage the U-shaped, upright side surfaces 206 and 207 of the two brackets, and to be attached to the brackets. See plates 30 in FIG. 16 having holes 212 for passing fasteners 213 that attach the lower plate to the bracket cross pieces 18*c* and 118*c*, and also having holes 214 for passing fasteners 32 that attach the plate 30 to mullion plate 11. A lateral dowel 216 may be employed to pass through lateral openings 217 in the bracket legs 28, and through corresponding openings 218 in mullion member 12 for additional locking together of the structure. Bracket legs 2 straddle mullion legs 13*a* and 13*b*.

Figure 10:
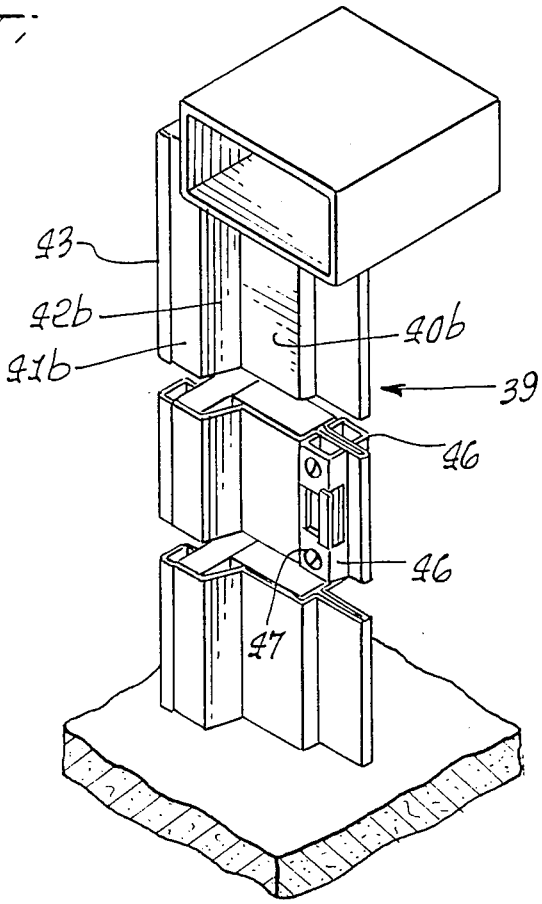
FIG. 10 is a view like FIG. 8 showing elements in fully assembled condition.
Figure 11:
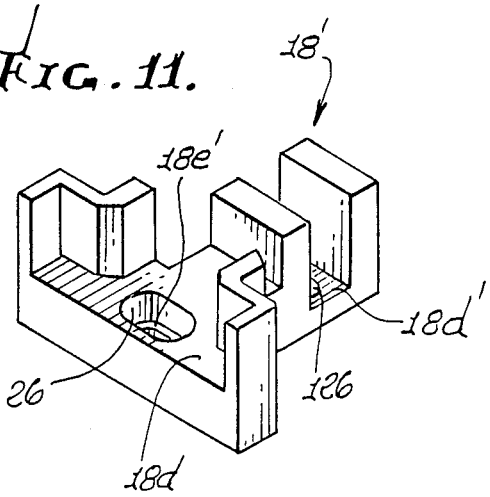
FIG. 11 is a perspective view of a mounting bracket.

The cover assembly 39 is then fitted about the mullion, as appears in FIG. 10.

FIG. 17 shows in horizontal section an application of the invention to nose-to-nose paired doors 300. Note that the cover assembly walls define a T-shape in horizontal cross section with a stem (formed by walls 44*a*and 44*b*) in alignment with adjacent edges 301 of the paired doors. The massive structural steel mullion resists several hundred pounds size load without permanent deflection.

I claim:

1. In a mullion assembly for door means, and attachable to support structure via a connector part, the combination comprising:

(a) an elongated upright mullion member having T-shape in horizontal cross section, (b) a foot bracket at an end of the mullion member and having associated adjustable means for connecting the bracket to support structure so that the bracket can be shifted horizontally relative to said connector part fixed to the support structure, and then attached to that part, (c) the foot bracket having T-shape in horizontal cross section to interfit the T-shape of the mullion for blocking sideward motion of the mullion relative to the bracket.

2. The combination of claim 1 wherein the T-shape of each of the mullion and bracket includes a base, and including a connector plate overlapping said bases, and attached thereto.

3. The combination of claim 1 wherein the T-shape of the mullion includes an upright stem which is hollow, the T-shape of the bracket having legs that align with said hollow mullion stem to block lateral displacement of the mullion relative to the bracket.

4. The combination of claim 1 including an upright cover assembly having walls fitting about the mullion and connected thereto.

5. The combination of claim 4 including said door means in the form of paired doors, the cover assembly walls defining a T-shaped in horizontal cross section with a stem in alignment wit adjacent edges of the paired doors.

6. The combination of claim 4 wherein the cover assembly walls define a T-shape in horizontal cross section, each of the T-shapes of the cover assembly and mullion having a stem, and there being flange means on and projecting parallel to the mullion T-shape stem, and the cover assembly including wall portions defining space closely receiving said flange means, and door strike means on said wall portions, said wall portions connected to said flange means.

7. The combination of claim 6 wherein said T-shape defined by the cover assembly walls includes base side walls, and a base end wall having snap-on connection to said base side walls.

8. The combination of claim 6 including door means having edge portions closed into adjacent relation to said cover assembly, the door means having bolt means received into said strike means.

9. The combination of claim 8 wherein said strike means include two strikes respectively at opposite sides of said wall portions, and including fasteners connecting said strikes to said wall portions, the fasteners extending through said wall portions and into the flange means.

10. The combination of claim 1 wherein said connector part comprises a vertical fastener, and said adjustable means on the front bracket comprises a through slot receiving said fastener, the slot elongated in the direction of the cross piece defined by the T-shape of the bracket.

11. The combination of claim 1 wherein said support structure and foot bracket are at the lower end of the mullion, including a second foot bracket at and connected to the upper end of the mullion, the second foot bracket having the same construction a the first mentioned foot bracket and adjustably connected to second support structure above the upper end of the mullion.

12. The combination of claim 1 including upright plate means attached to the mullion and to the foot bracket to retain the mullion to the bracket.

13. The combination of claim 1 wherein the foot bracket includes a horizontal base, and integral lugs projecting upright from the base to confine the end of the mullion, laterally, the mullion end seated on the bracket base.

* * * * *